US005469111A

United States Patent [19]

Chiu

[11] Patent Number: 5,469,111

[45] Date of Patent: Nov. 21, 1995

[54] CIRCUIT FOR GENERATING A PROCESS VARIATION INSENSITIVE REFERENCE BIAS CURRENT

[75] Inventor: Kwok-F Chiu, San Jose, Calif.

[73] Assignee: National Semiconductor Corporation, Santa Clara, Calif.

[21] Appl. No.: 295,331

[22] Filed: Aug. 24, 1994

[51] Int. Cl.[6] ..... G05F 1/10

[52] U.S. Cl. ..... 327/538; 327/540; 327/542; 327/543

[58] Field of Search ..... 327/538, 540, 327/541, 542, 543, 545, 546

[56] References Cited

U.S. PATENT DOCUMENTS

| | | | |
|---|---|---|---|
| 4,068,134 | 1/1978 | Tobey, Jr. et al. | 327/541 |
| 4,675,594 | 6/1987 | Reinke | 327/542 |
| 4,783,607 | 11/1988 | Hsieh | 327/541 |
| 4,837,459 | 6/1989 | Bukowski | 327/543 |
| 5,153,500 | 10/1992 | Yamamoto et al. | 327/542 |
| 5,339,272 | 8/1994 | Tedrow et al. | 327/540 |

OTHER PUBLICATIONS

Article entitled "A Quad CMOS Single–Supply Op Amp With Rail–to–Rail Output Swing" by Dennis M. Monticelli, IEEE Journal, vol. SC–21, No. 6, Dec. 1986, pp. 1026–1034.

Excerpt from book entitled "Analysis and Design of Analog Integrated Circuits", Second Edition, by Paul R. Gray and Robert G. Meyer, University of California, Berkeley, John Wiley & Sons, pp. 275–289.

*Primary Examiner*—Terry D. Cunningham

*Attorney, Agent, or Firm*—Skjerven, Morrill, MacPherson, Franklin & Friel; Edward C. Kwok

[57] ABSTRACT

In a comparator circuit, a reference bias current generation circuit uses an MOS transistor rather than a resistor to generate a current based on the difference between the base-emitter voltages of two bipolar transistors. In one embodiment, a second MOS transistor matched to the first MOS transistor is used to provide a current substantially independent of variations of the threshold voltage due to variations in the manufacturing process. A reference voltage source is provided to adjust the temperature coefficient of the reference bias current.

6 Claims, 9 Drawing Sheets

CIRCUIT FOR GENERATING A PROCESS VARIATION INSENSITIVE REFERENCE BIAS CURRENT

BACKGROUND OF THE INVENTION

1. Field of the Invention

The present invention relates to the design of electronic circuits, and in particular, relates to the design of CMOS integrated circuits.

2. Discussion of Related Art

A reference bias current can be generating from the difference in the base-emitter voltages of two bipolar transistors of different current densities. One such reference bias current generation circuit is disclosed in the article "A Quad CMOS Single-Supply Op Amp with Rail-to-Rail Output Swing" by D. Monticelli, *IEEE Journal of Solid-State Circuits,* vol.sc-21, No. 6, December 1986, pp. 1026–34.

A good reference disclosing general techniques for generating supply-independent or temperature-independent bias currents is *Analysis and Design of Analog Integrated Circuits,* by P. Gray and R. Meyer, second edition, pp. 275–289, published by John Wiley & Sons.

Another example of a reference bias current generation circuit is shown in FIG. 6. As shown in FIG. 6, reference bias current generation circuit 600 includes NPN bipolar transistors 601 and 602. In circuit 600, transistors 601 and 602 are designed to have different emitter areas. Thus, when both transistors 601 and 602 are conducting in the linear region, a difference ("$\delta V_{BE}$") between their base-emitter voltages results. The emitter terminal of transistor 601 is coupled to a current source 608 by resistor 603. The emitter terminal of transistor 602 is coupled to current source 609. Current sources 608 and 609 are designed to sink substantially the same current. In circuit 600, the voltage on node 607 (at the emitter terminal of transistor 602) and the voltage on node 603 are forced to be equal by the high gain of an operational amplifier 604, which provides a feedback signal at terminal 610 to control current sources 608 and 609. If the voltage at node 606 is slightly higher than the voltage at node 607, the bias voltage at current source 608 is increased to equalize the voltages at nodes 606 and 607. Conversely, if the voltage at node 606 is slightly lower than the voltage at node 607, the bias voltage at current source 608 is decreased to equalize the voltages at nodes 606 and 607. In equilibrium, the voltage $\delta V_{BE}$ is dropped across resistor 603. The current $i_{ref}$ in current sources 608 and 609 is determined by the size of resistor 603, and is given by:

$$i_{ref} = \frac{\delta V_{BE}}{R}$$

where R is the resistance of resistor 603. A ratioed current mirror can be used to generate a current equal to $i_{ref}$ or a current proportional to $\delta V_{BE}$.

In both of the prior art reference bias current generation circuits discussed above, a reference bias current arising from the difference in base-emitter voltages of two bipolar transistors is generated by imposing such voltage difference across a resistor. However, if a small reference bias current is preferred, such a resistor can occupy unreasonably large silicon real estate in an integrated circuit implementation. For example, in circuit 600 of FIG. 6 discussed above, if the emitter ratio between transistors 601 and 602 is 9:1, a $\delta V_{BE}$ of 57 millivolts results in one implmentation. In that implementation, to provide a reference current $i_{ref}$ of 0.2 microamps, resistor 603 is required a resistance of 285K. Such resistance is achieved in that implmentation only with an uneconomically large resistor.

Alternatively, the resistor in the prior art reference bias current generation circuit can be replaced by a field effect transistor (FET) operating in the non-saturation or "triode" region. Such an FET would require a much smaller silicon real estate than a resistor conducting the same amount of current. However, the use of an FET has at least two disadvantages. First, the threshold voltage ($V_T$) of such a transistor is known to vary substantially with variations in the manufacturing process. Consequently, the equivalence resistance attainable by such FET varies over a wide range, leading to large variation in the generated bias current. Secondly, the threshold voltage of such as FET is known to have a negative coefficient. Consequently, the bias current generated by such an FET also has a negative temperature coefficient, which is undesirable for most amplifier applications.

Thus, a reference bias current generation circuit which is relatively insensitive to process variations and which has a positive temperature coefficient is desired.

SUMMARY OF THE INVENTION

In accordance with the present invention, a comparator circuit is provided. The comparator circuit includes: (a) an input protection circuit having first and second terminals for receiving a differential input signal, and having third and fourth terminals for providing a differential output signal corresponding to the differential input signal; (b) an input stage circuit receiving the differential output signal, for providing a comparator output signal indicating whether the differential input signal is positive or negative; and (c) a bias circuit for providing a bias current used in the input protection circuit and the input stage circuit, where the bias circuit generates the bias current using a difference in base-emitter voltages of two bipolar transistors imposed across a source terminal and a drain terminal of an MOS transistor, and the bias circuit includes means for compensating for shifts in threshold voltage in the MOS transistor. In one embodiment, the comparator circuit further includes an output stage circuit for amplification of the comparator output signal.

In accordance to another aspect of the present invention, a reference bias current generation circuit is provided. The reference bias current generation circuit includes: (a) a first bipolar transistor having a collector coupled to a first supply voltage, a base terminal and an emitter terminal; (b) a second bipolar transistor having a collector coupled to the first supply voltage, a base terminal coupled to the base terminal of the first bipolar transistor and an emitter terminal; (c) a first MOS transistor having a drain terminal coupled to the emitter terminal of the first bipolar transistor, a gate terminal and a source terminal; (d) an operational amplifier having a first input terminal coupled to the emitter terminal of the second bipolar transistor and a second input terminal coupled to the source terminal of the first MOS transistor, the operational amplifier providing an output signal having a magnitude indicative of the difference between the voltages at its first and second input terminals; (e) a first current source coupled between the source terminal of the first MOS transistor and a second supply voltage, the first current source receiving and responsive to the output signal of the operational amplifier; (f) a second current source coupled to the emitter terminal of the second bipolar transistor and the second supply voltage; and (g) means for compensating threshold voltage shifts in the first MOS transistor.

By using an MOS transistor and imposing the difference between the base-emitter voltages of the first and second bipolar transistors across the drain and source terminals of the MOS transistor, the necessity for a sizeable resistor is avoided.

In one embodiment of the present invention, the reference bias current generation circuit further includes: (a) a second MOS transistor having a drain terminal and a gate terminal coupled to the first supply voltage, and a source terminal coupled to the base terminal of the first bipolar transistor; (b) a third bipolar transistor having a collector terminal and a base terminal coupled to the first supply voltage and an emitter terminal coupled to the gate terminal of the first MOS transistor; (c) a third current source coupled to the base terminal of the first bipolar transistor and the supply voltage; and (d) a fourth current source coupled to the emitter terminal of the third bipolar transistor and the second supply voltage.

In one embodiment of the present invention, the reference bias current generation circuit couples the gate terminal of the first MOS transistor to the emitter terminal of the third bipolar transistor using a reference voltage source.

In another embodiment of the present invention, the reference bias current generation circuit couples the source terminal of the second MOS transistor to the base terminal of the first bipolar transistor using a reference voltage source.

The reference bias current generation circuit is designed such that the third current source has a quiescent current twice the magnitude of the corresponding current in the first current source, and such that the first and second MOS transistors have the same physical dimensions. In this manner, the reference bias current thus generated is substantially independent of variations in the threshold voltage due to variations in the manufacturing process. In addition, the overall temperature coefficient of the reference bias current is positive, which is desirable in most amplifier applications.

By adjusting the size of the reference voltage source, even further control of the reference bias current's temperature coefficient is provided.

The present invention is better understood upon consideration of the detailed description below and the accompanying drawings.

DETAILED DESCRIPTION OF THE PREFERRED EMBODIMENTS

Figure 1:
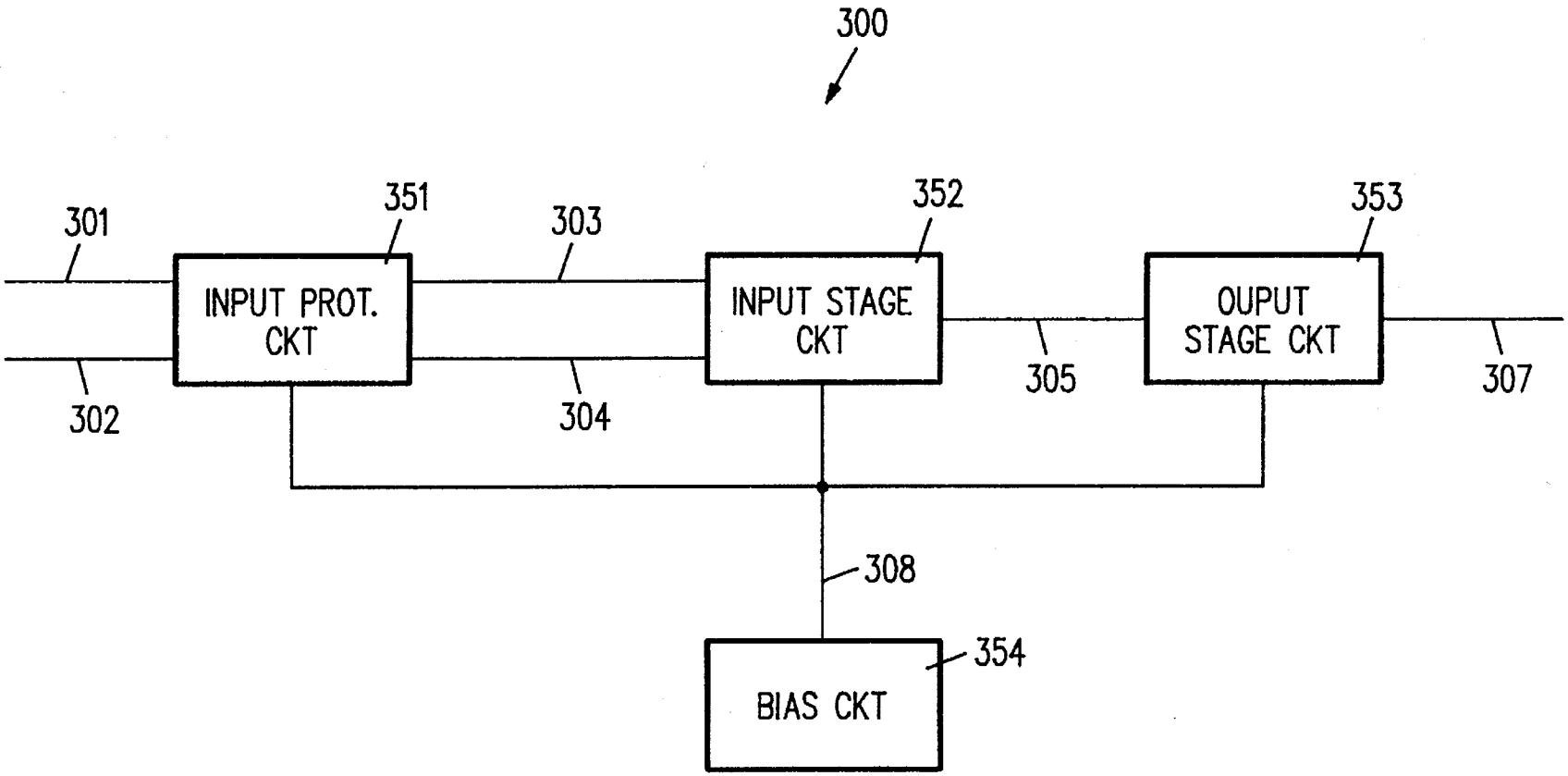
FIG. 1 shows a comparator 300, in accordance with one embodiment of the present invention.
Figure 3A:
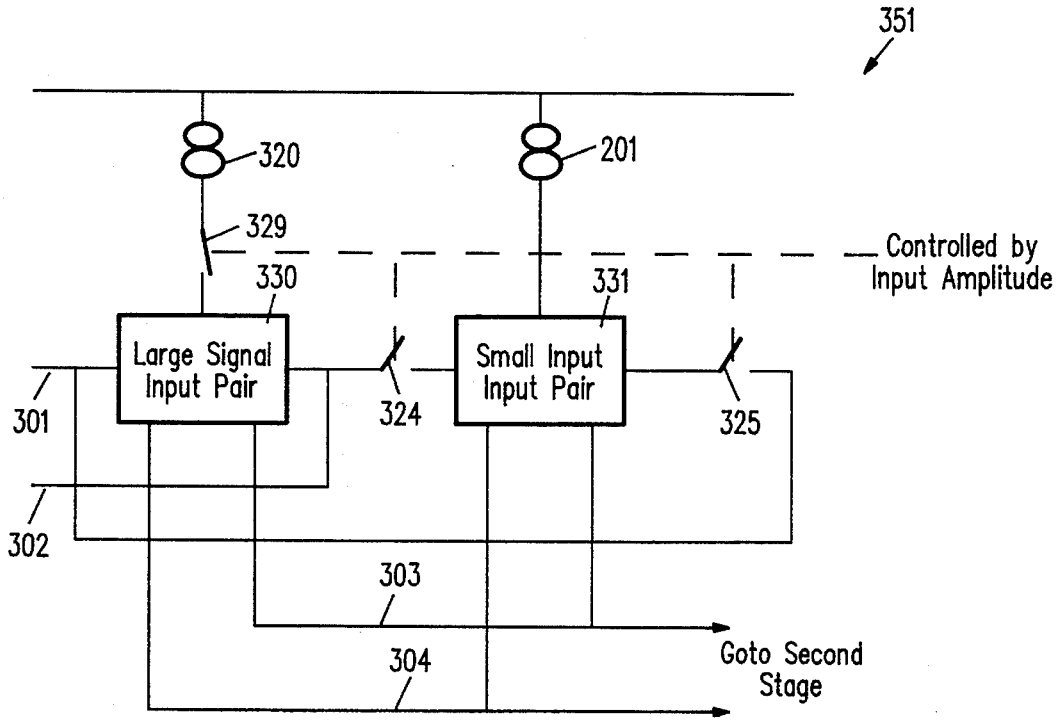
FIG. 3*a* is a block diagram of input protection circuit 351 of the present embodiment.
Figure 3B:
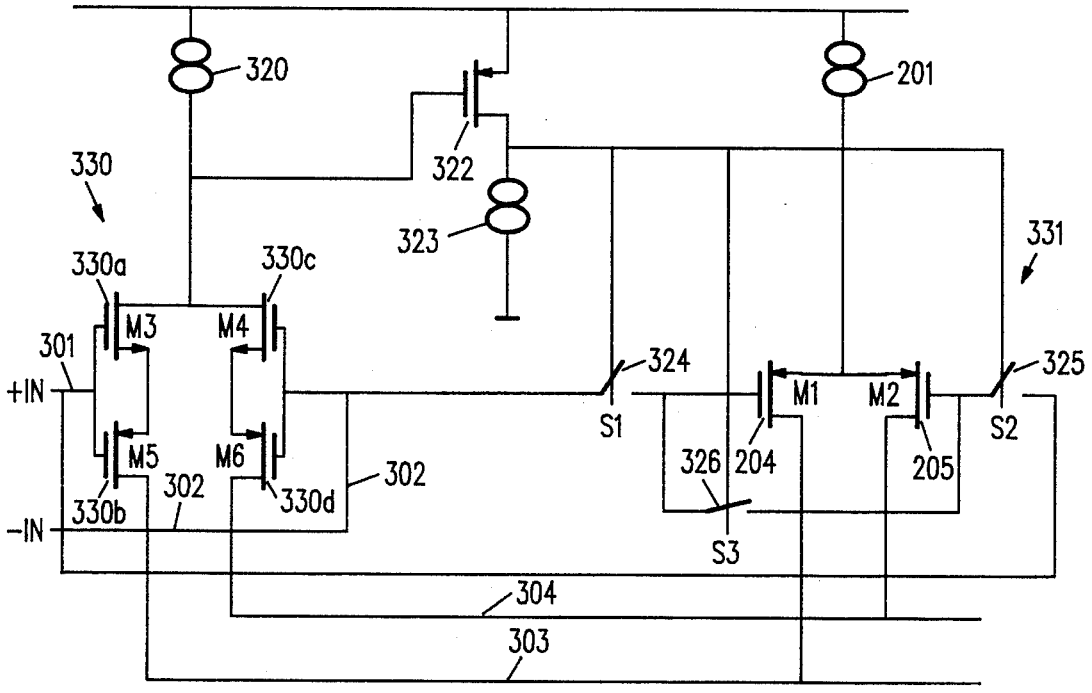
FIG. 3*b* is a schematic circuit of input protection circuit 351 of the present embodiment.
Figure 3C:
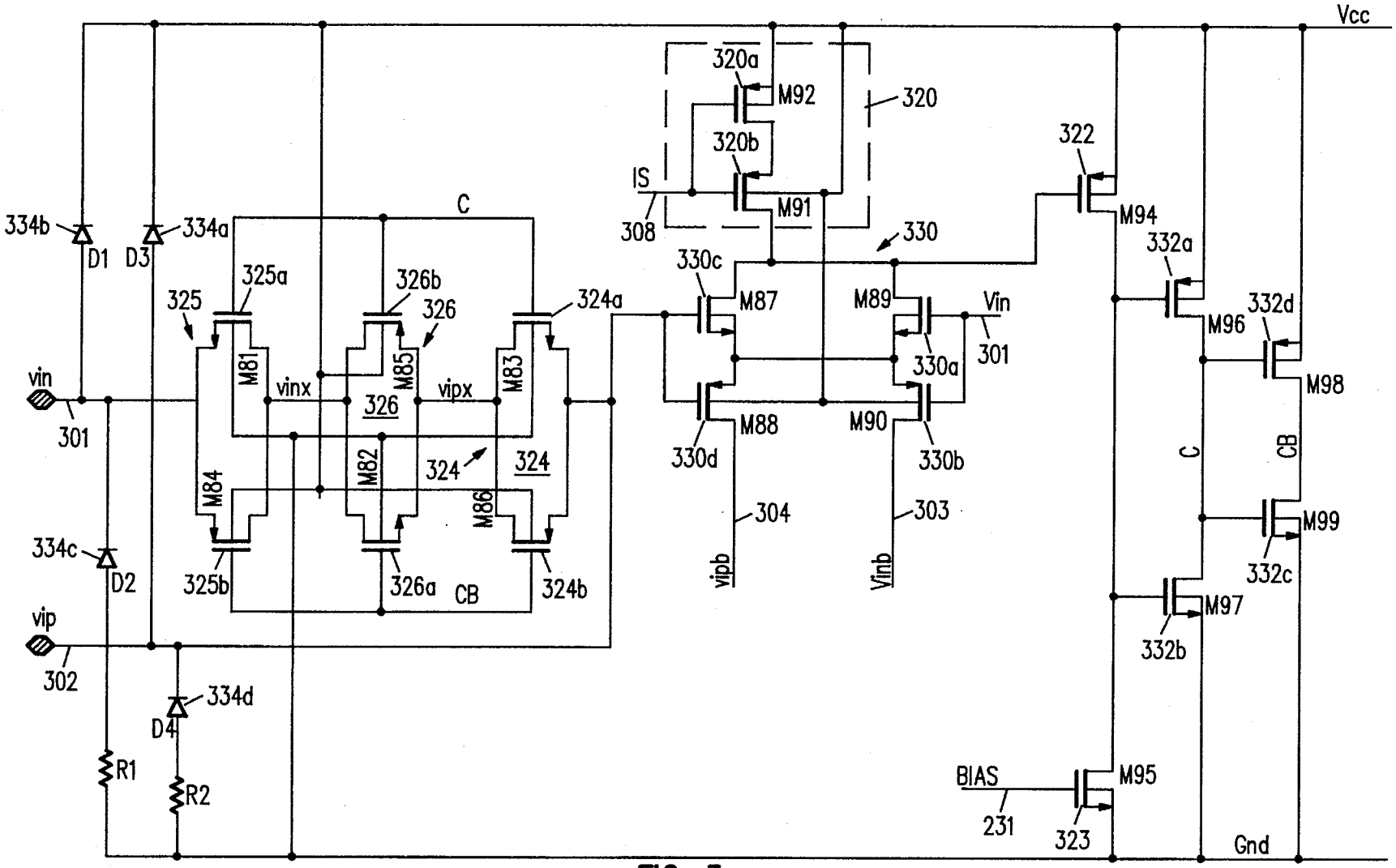
FIG. 3*c* is a transistor level schematic circuit showing in further detail input protection circuit 351 of the present embodiment.

One embodiment of the present invention is provided in a comparator circuit 300 shown in FIG. 1. FIG. 1 is a block diagram of comparator circuit 300, which can be implemented as a CMOS integrated circuit. As shown in FIG. 1, comparator 300 includes input protection circuit 351, input stage circuit ("AB cascode amplifier") 352, output stage circuit 353 and bias circuit 354. A differential signal is received into input protection circuit 351 across terminals 301 and 302. Input protection circuit is designed to minimize comparator 300's "$V_{os}$" (offset voltage) performance. FIGS. 3*a*, 3*b* and 3*c* are respectively a block diagram and a schematic circuit, and a transistor level schematic circuit for input protection circuit 351, which is described in further detail in copending patent application entitled "Input Protection Circuit for a CMOS Comparator," by Kwok-Fu Chiu et al, Ser. No. 08/296,056, filed on the same day as the present application, assigned to National Semiconductor Corp., also the assignee of the present invention. Input protection circuit 351 provides a differential output signal across terminals 303 and 304 substantially proportional to the differential input signal across terminals 301 and 302.

Figure 2A:
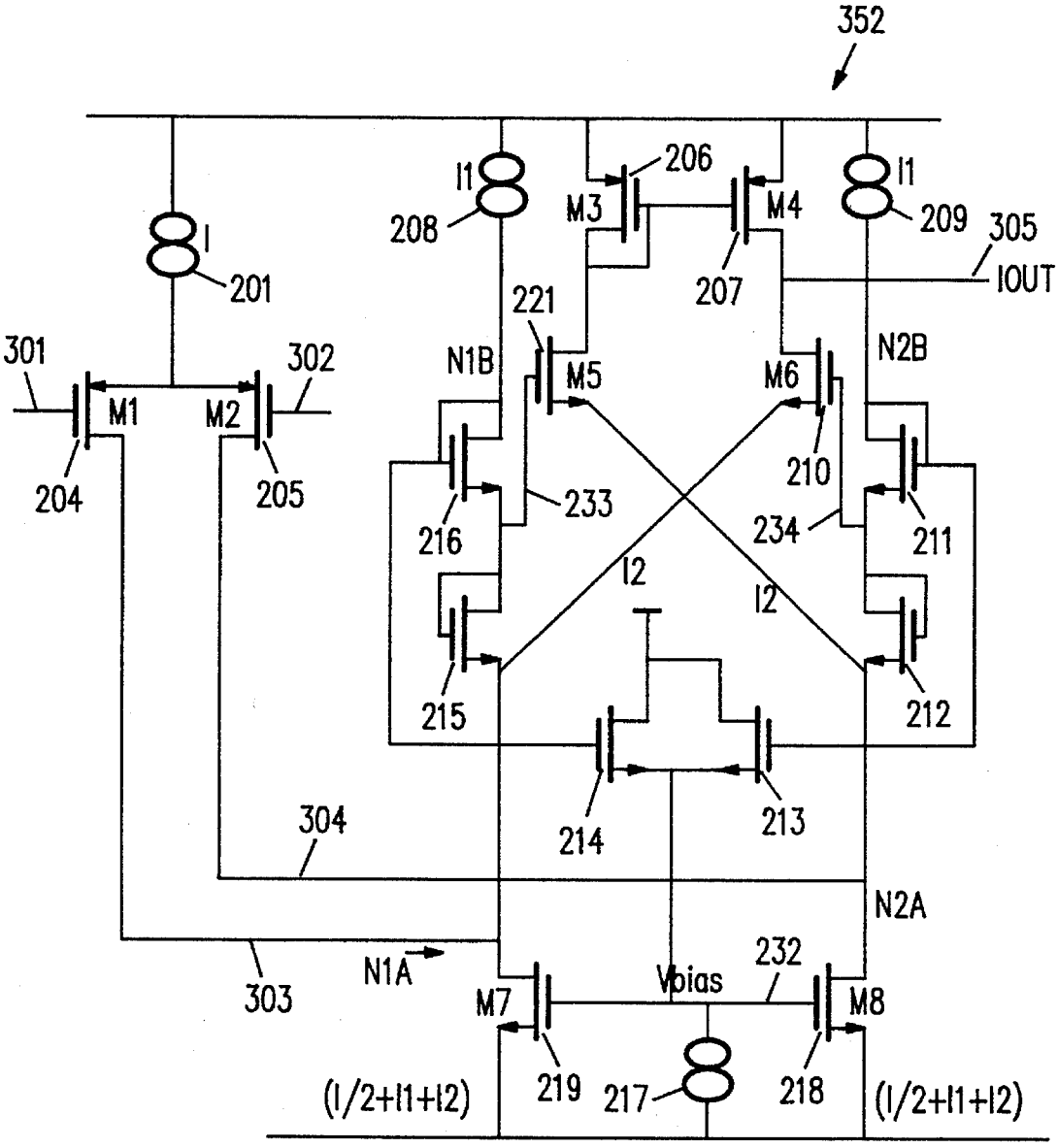
FIG. 2*a* is a schematic diagram of an AB cascode amplifier 352, in accordance with the present invention.
Figure 2B:
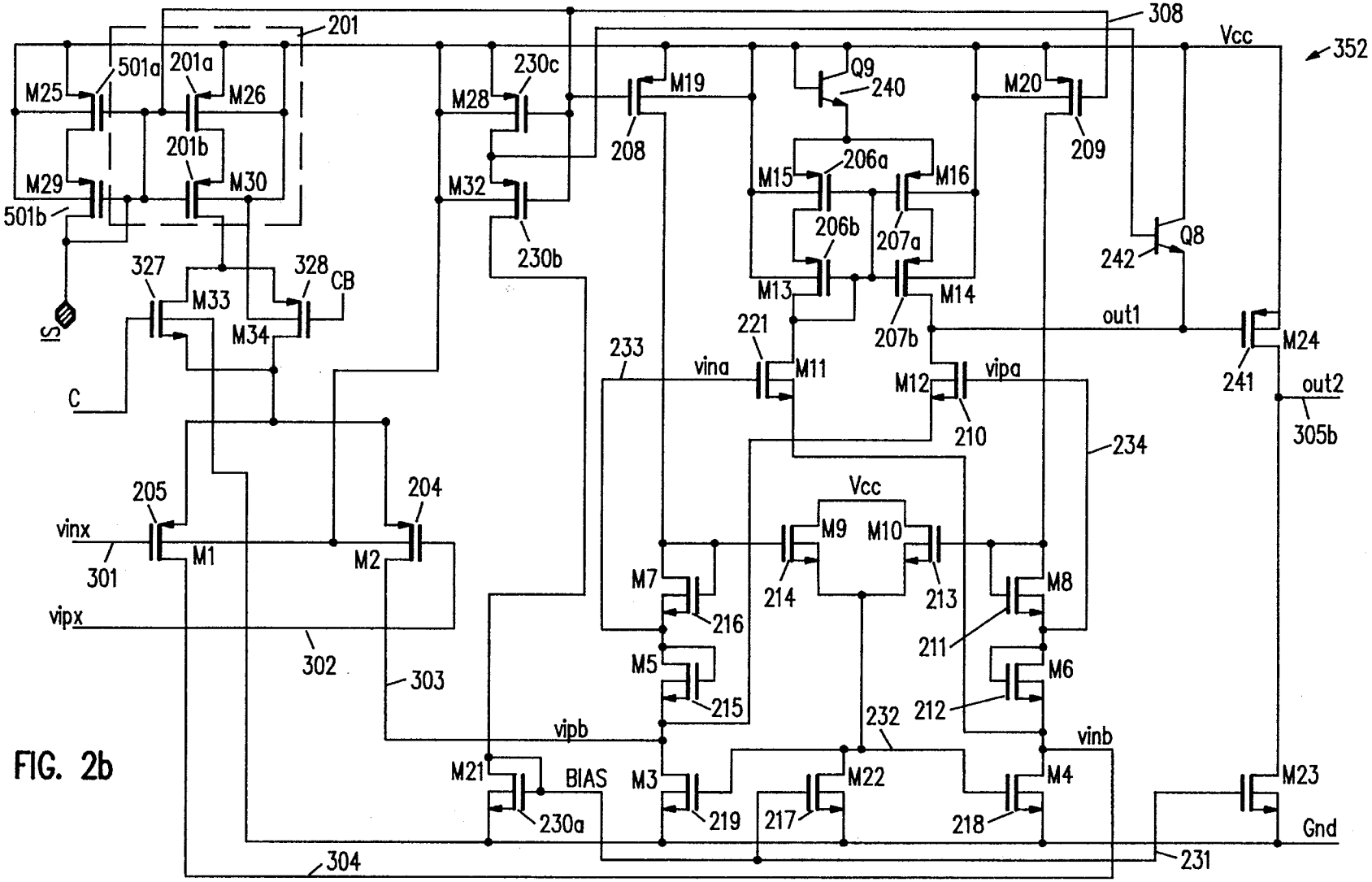
FIG. 2*b* is a transistor level schematic circuit showing in further detail the schematic diagram of AB cascode amplifier 352.

FIGS. 2*a* and 2*b* are respectively a schematic diagram and a transistor level schematic diagram of input stage circuit 352. Input stage circuit 352 is described in copending patent application entitled "AB Cascode Amplifier in an input stage of an Amplifier or Comparator," by Kwok-Fu Chiu et al, Ser. No. 08/296,057, filed on the same day as the present application, assigned to National Semiconductor Corp., also the assignee of the present invention.

In response to the differential signal across terminals 303 and 304, input stage circuit 352 provides an output signal 305 which is indicative of whether the voltage at terminal 301 is higher than the voltage at terminal 302. The voltage $V_{os}$ represents the minimum voltage by which the voltage at terminal 301 must exceed the voltage at terminal 302 to drive the output signal at terminal 305 to "logic high".

Figure 4A:
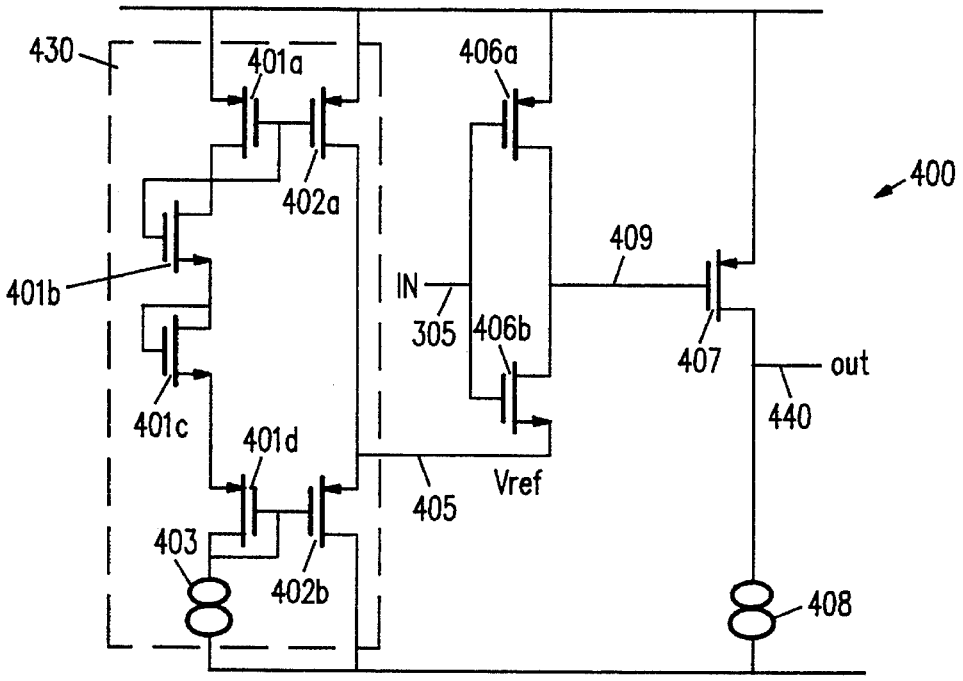
FIG. 4*a* is a schematic circuit of output stage circuit 353 of the present embodiment.
Figure 4B:
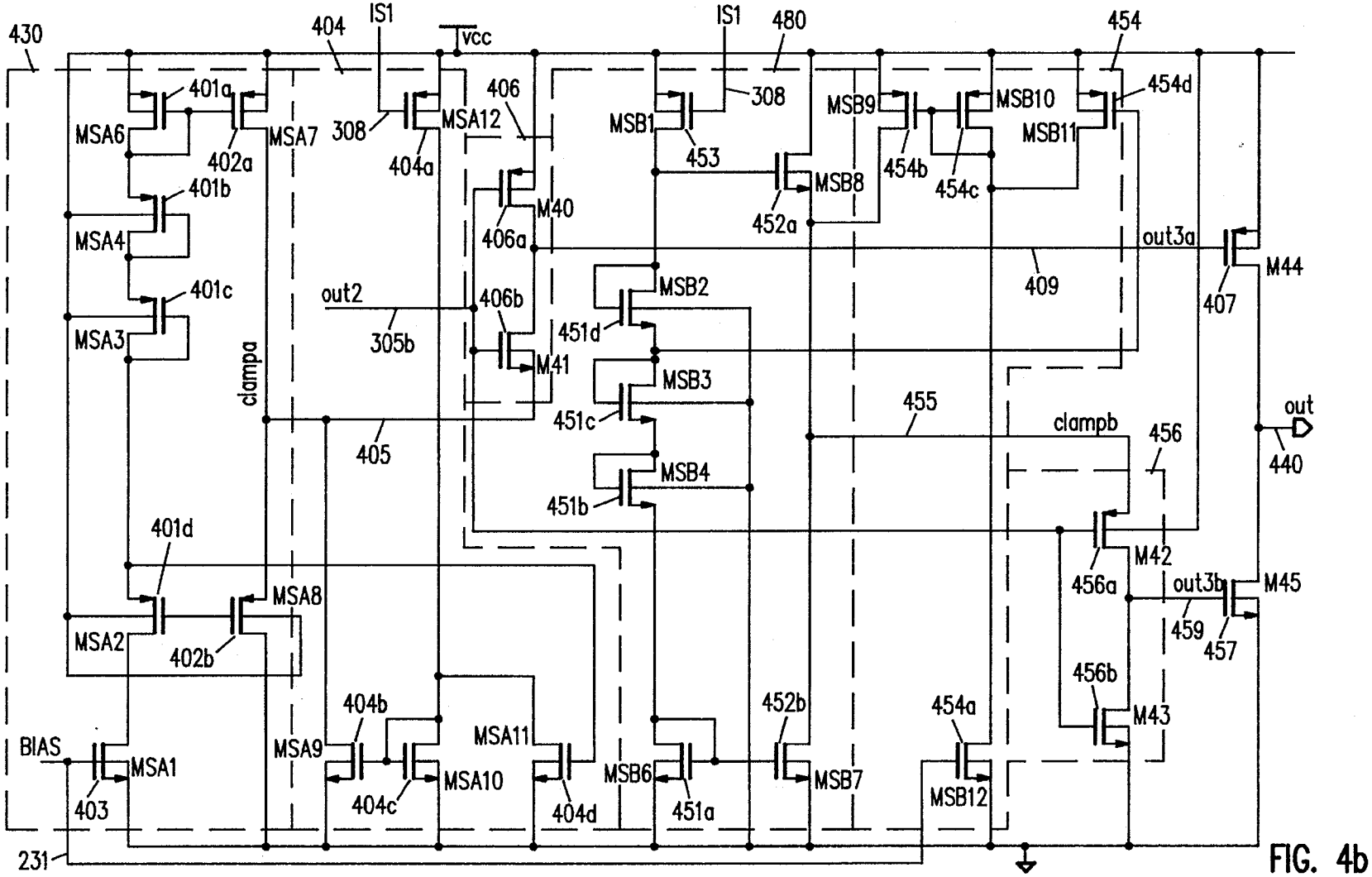
FIG. 4*b* is a transistor level schematic circuit showing in further detail output stage circuit 353 of the present invention.

The output signal at terminal 305 is amplified by output stage circuit 353 as the output signal of comparator 300. This output signal of comparator 300 is provided at terminal 307. Output stage circuit 353 includes a structure adapted for short circuit protection. FIG. 4*a* and 4*b* are schematic circuits of output stage 353. Output stage 353 is described in further detail in copending patent application entitled "Output Circuit with Short Circuit Protection in a CMOS Comparator," by Kwok-Fu Chiu et al, Ser. No. 08/295,135, filed on the same day as the present application, assigned to National Semiconductor Corp., also the assignee of the present invention.

Figure 5A:
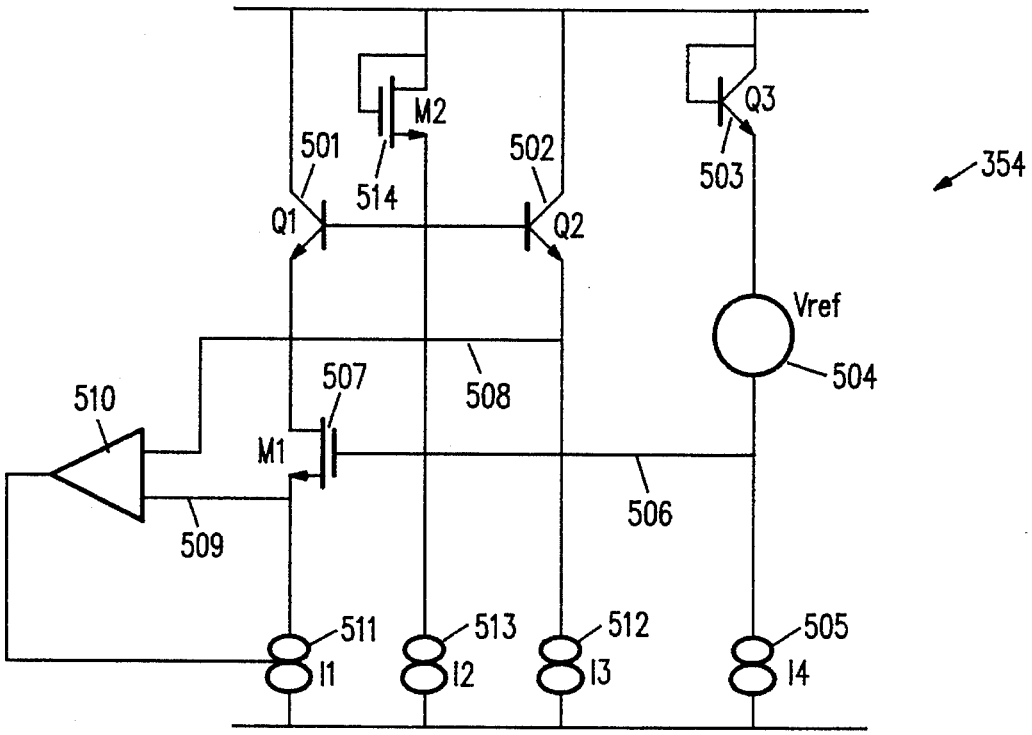
FIG. 5*a* is a schematic circuit of bias circuit 354 of the present embodiment.
Figure 5B:
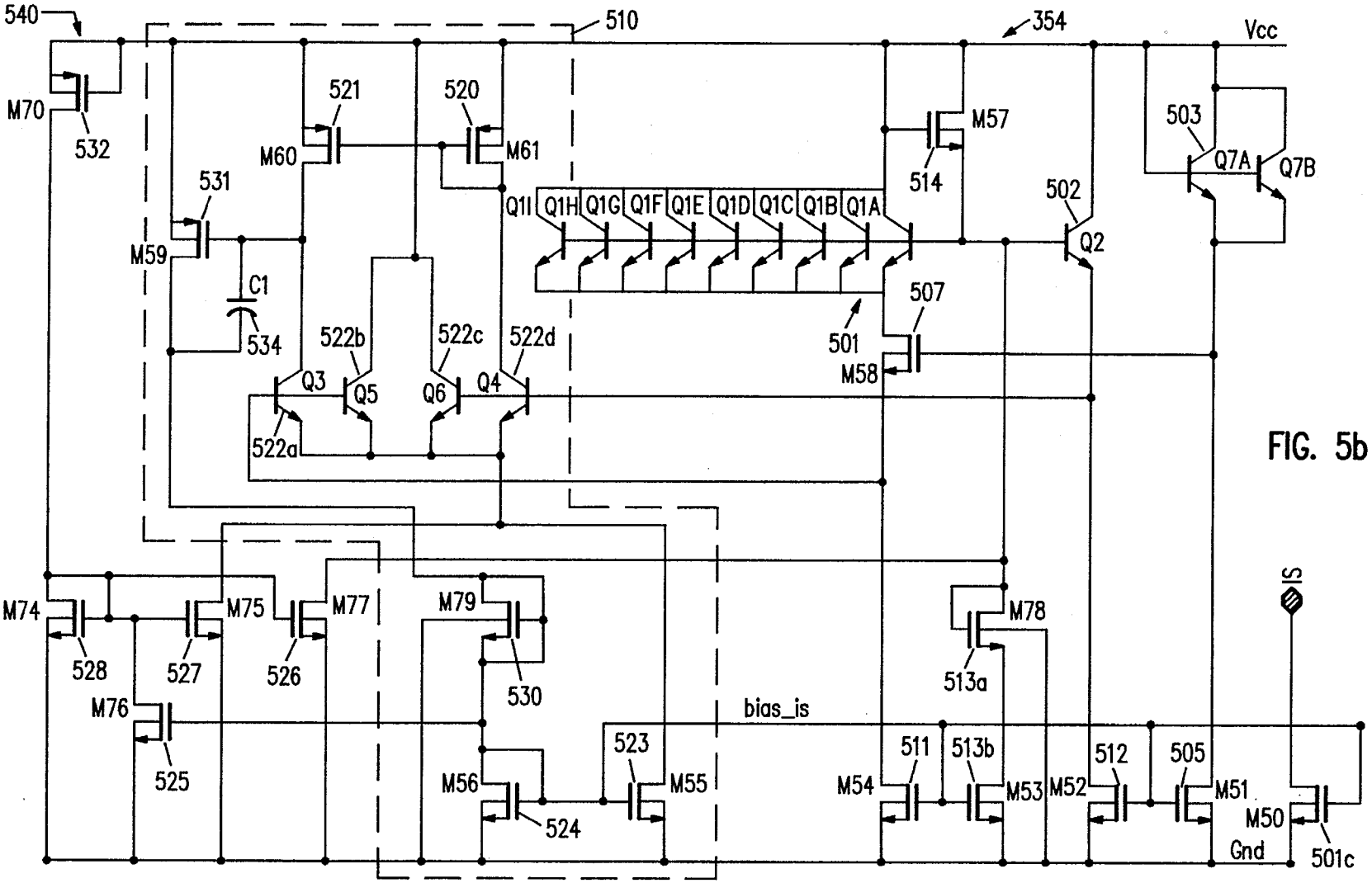
FIG. 5*b* is a transistor level schematic circuit showing in further detail bias circuit 354 of the present embodiment.
Figure 6:
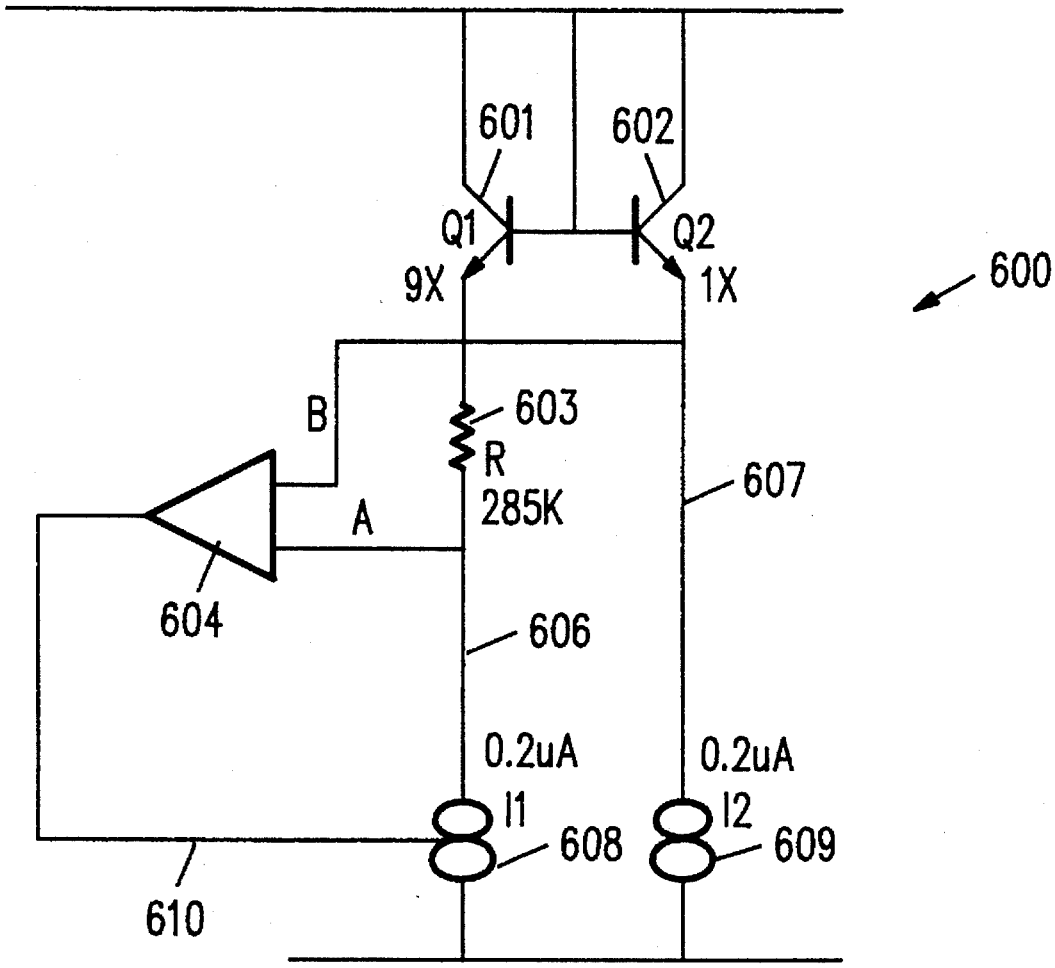
FIG. 6 shows a prior art circuit 600 for generating a reference signal.

Input protection circuit 351, input stage circuit 352 and output stage circuit 353 all receive a bias voltage at terminal 308 from bias circuit 354. This bias voltage is designed to be process variation insensitive so as to ensure each implementation of comparator 300 provide the same reliable operation regardless of the variations in the manufacturing process. FIGS. 5*a* and 5*b* are schematic diagrams of bias circuit 354 of the present invention. Bias circuit 354 is described in further detail below.

The present invention provides a reference bias current generation circuit using a transistor, rather than a resistor. In addition, the reference bias current generation includes a compensating transistor so that the reference bias current generated has a positive temperature and is insensitive to variations in the threshold voltage ($V_T$) of MOS transistors resulting from variations in the manufacturing process. A reference voltage source can also be provided to further adjust the temperature coefficient of the reference current.

The present invention is illustrated by FIGS. 5*a* and 5*b*. FIGS. 5*a* and 5*b* are a schematic diagram of bias circuit 354 and a transistor level schematic diagram of bias circuit 354, respectively. Corresponding elements of FIGS. 5*a* and 5*b* are given identical reference numerals to facilitate the discussion below.

As shown in FIG. 5*a*, a diode-connected NPN transistor 503 is connected in series with a voltage source 504. The voltage across voltage source 504 is denoted $V_{ref}$. The current in voltage source 504 is sunk by current source 505. The voltage at node 506, i.e. supply voltage $V_{cc}$ minus the sum of the base-emitter voltage of transistor 503 and $V_{ref}$, is coupled to the gate terminal of transistor 507. Transistor 507 acts as a resistor in the reference bias current generation circuit 354, in that the difference ($\delta V_{BE}$) in base-emitter voltages of NPN transistors 501 and 502 is dropped across the drain terminal and the source terminal of transistor 507, using operational amplifier 510 in a feedback configuration to force the voltages on nodes 508 and 509 to be equal. In this embodiment, the ratio of the emitter areas of transistors 501 and 502 is 9:1. The currents in transistor 501 and 502 are sunk by current sources 511 and 512, respectively. Transistor 503 is designed to have twice the size of transistor 502. The feedback signal of operational amplifier 510 is used to control the bias voltage of current source 511. The common base of transistors 501 and 502 are biased by a diode-connected transistor 514, which has the same physical dimensions as transistor 507. Transistor 514 is connected between the supply voltage Vcc and the common base terminal of transistors 501 and 502. The current in transistor 514 is sunk by a current source 513, which is designed to conduct twice the current of current source 511.

The embodiment shown in FIG. 5*b* corresponds to the case in which $V_{ref}$ is zero. The present invention is first discussed using the embodiment of FIG. 5*b* as an example. The voltage on node 509 is $V_{cc}$ minus the sum of the gate-to-source voltage ("$V_{GS}$") of transistor 507 and the base-emitter voltage ("$V_{BE}$") of transistor 503. At the same time, the voltage on node 508 is given by $V_{cc}$ minus the sum of transistor 514's $V_{GS}$ and transistor 502's $V_{BE}$. Since operational amplifier 501 forces the voltages of nodes 508 and 509 to be the same, the $V_{GS}$'s of transistors 507 and 514 are therefore approximately equal. Current sources 511 and 513 are designed to sink currents in the ratio of 1:2. In FIG. 5*b*, current source 513 is shown implemented by serially connected transistors 513*a* and 513*b*. Transistor 513*a* is a level converter for adjusting the voltage at the common base terminal of transistors 501 and 502. Current sources 511 and 513 are implemented by NMOS transistors 511 and 513*b*, which are ratioed at 1:2. The operating points of transistors 507 and 514 are selected to be in the linear and saturation regions respectively. Accordingly, for transistor 507, the following equation is satisfied:

$$I_{D,507} = \left(\frac{W}{L}\right)(\beta)\left(V_{GS,507} - V_T - \frac{V_{DS,507}}{2}\right)V_{DS,507}$$

where $V_{DS,507}$ is the drain-to-source voltage of transistor 507, $V_{GS,507}$ is the gate-to-source voltage of transistor 507, and $I_{D,507}$ is the drain current in transistor 507, and $\beta$ is substantially a constant. As discussed above, this $V_{DS,507}$ is constrained by operational amplifier 510 to $\delta V_{BE}$ between the base-emitter voltages of transistors 501 and 502.

At the same time, the operating point of transistor 514 is chosen to be in saturation region. Since the current in transistor 514 is constrained to be twice the current in transistor 507, the current in transistor 514 satisfies the following equation:

$$I_{D,514} = 2I_{D,507} = \frac{1}{2}\left(\frac{W}{L}\right)(\beta)(V_{GS,514} - V_T)^2 \quad (2)$$

where $I_{D,514}$ and $V_{GS,514}$ are the drain current of transistor 514 and the gate-to-source voltage of transistor 514, respectively. Consequently, the current in transistor 507 can be shown to be given by:

$$I_{D,507} = 2\left(\frac{W}{L}\right)(\beta)V_{DS,507}^2 \quad (3)$$

which is substantially independent of the threshold $V_T$. (For convenience, $I_{D,507}$ and $V_{GS,507}$ are referred to as $I_D$ and $V_{DS}$ in the following, when the context allows little risk of confusion). Indeed, a computer simulation of FIG. 5*b*'s circuit 354 shows a 2% variation in the reference bias current, for a 150 millivolts change in $V_T$ in each of transistors 507 and 514. The current in transistor 507 is mirrored, for example, in transistor 501c to provide a reference bias current. In this embodiment, the transistors 507 and 514 each have a width of 20 microns and a channel length of 48 microns. In this embodiment, current sources 511 and 512 each sink 200 nanoamps, and current source 513 sinks 400 nanoamps. In that embodiment, transistors 511 and 512 each have a width of 15 microns and a channel length of 48 microns. In that same embodiment, transistor 513*b* has a width of 30 microns and a channel length of 48 microns. Using a suitable ratio, e.g. a width of 18 microns and a channel length of 48 microns, the current in transistor 501*c* can be provided a reference bias current of 240 nanoamps. Using the same technique, the current in current source 505 (i.e transistor 505) is designed to sink approximately 133 nanoamps. FIG. 5*b* also shows an operational amplifier 510 including PMOS transistors 531, 521, and 520, NPN transistors 522*a*–522*d*, capacitor 534 and NMOS transistors 523, 524 and 530. In addition, FIG. 5*b* also shows a start-up circuit 540 including PMOS transistors 532 and NMOS transistors 525–528, which prevent the current from operating in a stable state of zero current flow, even when the power supply voltage is non=–zero.

Referring to equation (3) above, it is known that (i) the constant $\beta$ has a negative temperature coefficient (TC) approximately proportional to $T^{-3/2}$, T being the operating temperature, and (ii) $V_{DS}$ varies approximately with the operating temperature T. Thus, the current $I_D$, as a whole, varies approximately with $T^{1/2}$. In a simulation of the circuit 354 of FIG. 5*b*, current $I_D$ has a partly linear temperature coefficient of approximately 2000 ppm/°C.

Further adjustment to TC is possible by using a non-zero reference voltage $V_{ref}$. The temperature coefficient of the reference voltage $V_{ref}$ of voltage source 504 varies in opposite direction with the temperature coefficient of the reference bias current. Thus, if $V_{ref}$ has a positive TC, then the reference bias current will become more negative. For example, such a voltage $V_{ref}$ can be provided by a diode or a resistor with a positive temperature coefficient. Alternatively, rather than coupling voltage source between current source 505 and NPN transistor 503, voltage source 504 can also be coupled between the common base terminal of transistors 501 and 502 and the source terminal of transistor 514.

The above detailed description is provided to illustrate the specific embodiments of the present invention and is not intended to be limiting. Numerous variations and modification within the scope of the present invention are possible. The present invention is defined by the following claims.

We claim:

1. A reference bias current generation circuit, comprising:

a first bipolar transistor having a collector coupled to a first supply voltage, a base terminal and an emitter terminal;

a second bipolar transistor having a collector coupled to said first supply voltage, a base terminal coupled to said base terminal of said first bipolar transistor and an emitter terminal;

a first MOS transistor having a drain terminal coupled to said emitter terminal of said first bipolar transistor, a gate terminal and a source terminal;

an operational amplifier having a first input terminal coupled to said emitter terminal of said second bipolar transistor and a second input terminal coupled to said source terminal of said first MOS transistor, said operational amplifier providing an output signal having a magnitude indicative of the difference between the voltages at said first and second input terminals;

a first current source coupled between said source terminal of said first MOS transistor and a second supply voltage, said first current source receiving and responsive to said output signal of said operational amplifier;

a second current source coupled to said emitter terminal of said second bipolar transistor and said second supply voltage; and means, coupled to the base terminal of the first bipolar transistor and the gate terminal of the first MOS transistor, for compensating the current through said first MOS transistor variations due to a shift in the threshold voltage of said first MOS transistor.

2. A reference bias current generation circuit as in claim 1, wherein said means for compensating comprises:

a second MOS transistor having a drain terminal and a gate terminal coupled to said first supply voltage, and a source terminal coupled to said base terminal of said first bipolar transistor;

a third bipolar transistor having a collector terminal and a base terminal coupled to said first supply voltage and an emitter terminal coupled to said gate terminal of said first MOS transistor;

a third current source coupled to said base terminal of said first bipolar transistor and said second supply voltage; and a fourth current source coupled to said emitter terminal of said third bipolar transistor and said second supply voltage.

3. A reference bias current generation circuit as in claim 2, wherein said gate terminal of said first MOS transistor is coupled to said emitter terminal of said third bipolar transistor via a reference voltage source.

4. A reference bias current generation circuit as in claim 2, wherein said source terminal of said second MOS transistor is coupled to said base terminal of said first bipolar transistor via a reference voltage source.

5. A reference bias current generation circuit as in claim 2, wherein said third current source having a quiescent current which is twice the magnitude of the corresponding current in said first current source.

6. A reference bias current generation circuit as in claim 2, wherein said first and second MOS transistors have the same physical dimensions.

* * * * *